US008006504B2

(12) United States Patent
Ko et al.

(10) Patent No.: US 8,006,504 B2
(45) Date of Patent: Aug. 30, 2011

(54) AIR CONDITIONING SYSTEM

(75) Inventors: Young Hwan Ko, Changwon-si (KR); Bum Suk Kim, Changwon-si (KR); Man Ho Chun, Changwon-si (KR); Sang Kyoung Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 496 days.

(21) Appl. No.: 12/213,292

(22) Filed: Jun. 17, 2008

(65) Prior Publication Data

US 2009/0165481 A1 Jul. 2, 2009

(30) Foreign Application Priority Data

Dec. 26, 2007 (KR) ..... 10-2007-0137738
Dec. 26, 2007 (KR) ..... 10-2007-0137742

(51) Int. Cl.
*F25B 49/00* (2006.01)
*F25B 41/00* (2006.01)

(52) U.S. Cl. ..... 62/126; 62/127; 62/197; 62/509

(58) Field of Classification Search ..... 62/126, 62/127, 129, 196.1, 196.4, 197, 509, 510, 62/175

See application file for complete search history.

(56) References Cited

U.S. PATENT DOCUMENTS

| | | | | |
|---|---|---|---|---|
| 5,095,712 | A | 3/1992 | Narreau | |
| 6,155,075 | A * | 12/2000 | Hanson et al. | 62/512 |
| 6,354,092 | B1 | 3/2002 | Young et al. | |
| 6,401,485 | B1 | 6/2002 | Hildreth, Jr. | |
| 6,578,373 | B1 | 6/2003 | Barbier | |
| 2004/0099007 | A1 | 5/2004 | Lee et al. | |
| 2004/0194485 | A1 | 10/2004 | Dudley | |
| 2006/0277931 | A1 * | 12/2006 | Nakamura et al. | 62/196.1 |

FOREIGN PATENT DOCUMENTS

| | | |
|---|---|---|
| CN | 1255658 | 5/2006 |
| EP | 0 300 866 | 1/1989 |
| EP | 1 647 783 | 4/2006 |
| JP | 4-313647 | 11/1992 |
| JP | 2005-147456 | 6/2005 |

* cited by examiner

*Primary Examiner* — Marc E Norman
(74) *Attorney, Agent, or Firm* — McKenna Long & Aldridge LLP

(57) ABSTRACT

It is possible to prevent that a liquid refrigerant is included in a refrigerant injected into a compressor. Accordingly, the risk of liquid compression of the compressor is greatly reduced, thereby decreasing the possibility of damage to the compressor and improving reliability and performance.

15 Claims, 14 Drawing Sheets

AIR CONDITIONING SYSTEM

This nonprovisional application claims priority under 35 U.S.C. §119(a) on Patent Application No. 10-2007-0137738 filed in Republic of Korea on Dec. 26, 2007 and No. 10-2007-0137742 filed on Dec. 26, 2007 the entire contents of which are hereby incorporated by reference.

BACKGROUND OF THE INVENTION

1. Field of the Invention

The present invention relates to an air conditioning system, and more particularly, to an air conditioning system, which judges whether a liquid refrigerant is included in a refrigerant injected by a compressor, and prevents liquid compression from occurring in the compressor.

2. Discussion of the Related Art

Generally, an air conditioning system is an apparatus which cools or heats indoor spaces by compressing, condensing, expanding, and evaporating a refrigerant.

The air conditioning systems are classified into a normal air conditioner including an outdoor unit and an indoor unit connected to the outdoor unit and a multi-type air conditioner including an outdoor unit and a plurality of indoor units connected to the outdoor unit. Moreover, the air conditioning systems are classified into a cooling air conditioner supplying a cool air only to an indoor space by driving a refrigerant cycle in one direction only and a cooling and heating air conditioner supplying a cool or hot air to an indoor space by driving a refrigerant cycle selectively and bi-directionally.

The air conditioning system includes a compressor, a condenser, an expansion valve, and an evaporator. The refrigerant discharged from the compressor is condensed in the condenser, and then expands in the expansion valve. The expanded refrigerant is evaporated in the evaporator, and then sucked into the compressor. IN a cooling operation or heating operation, a gaseous refrigerant is injected into the compressor, thus improving performance.

However, if a liquid refrigerant exists in the injected refrigerant, there may occur a problem that liquid compression occurs in the compressor, thus damaging the compressor.

SUMMARY OF THE INVENTION

It is an object of the present invention to provide n air conditioning system, which can improve performance and stability by preventing a liquid refrigerant from being included in a refrigerant injected by a compressor.

To achieve the above object, there is provided an air conditioning system according to the present invention, comprising: a condenser for condensing a refrigerant; an evaporator for evaporating the refrigerant passed through the condenser; a compressor for compressing the refrigerant passed through the evaporator and a refrigerant injected after branched from the refrigerant flowing from the condenser to the evaporator; and a control unit for judging whether a liquid refrigerant is included in the injected refrigerant.

In the present invention, if at least one of operating parameters is out of a preset normal operating range, the control unit judges that a liquid refrigerant is included in the injected refrigerant. The operating parameters may include the discharge temperature and discharge pressure of the compressor, the inlet side temperature of the evaporator, the indoor temperature and outdoor temperature of the air conditioning system, and the current applied to the compressor, and if at least one of the operating parameters is out of the normal operation range, the control unit may judge that a liquid refrigerant is included in the injected refrigerant.

In the present invention, the air conditioning system further comprises an injection pipe through which the injected refrigerant flows and an injection valve disposed on the injection pipe, and if the operating parameter is out of the normal operating range, the injection valve may be closed for a first set time. If the number of times of the operating parameter being out of the normal operation range exceeds a set number of times, the injection valve may be closed for a second set time which is longer than the first set time. Further, if the number of times of the operating parameter being out of the normal operation range exceeds a set number of times, a warning may be indicated to the outside.

In the present invention, the air conditioning system further comprises a liquid refrigerant detection sensor disposed on the injection pipe through which the injected refrigerant flows, and the control unit may judge that a liquid refrigerant is included in the injected refrigerant on the basis of data received from the liquid refrigerant detection sensor.

In the present invention, the air conditioning system further comprises an injection pipe through which a refrigerant flows and an injection valve disposed on the injection pipe, and if it is judged that a liquid refrigerant is included in the injected refrigerant, the control unit controls the injection valve to be closed.

In the present invention, if it is judged that a liquid refrigerant is included in the injected refrigerant, the control unit controls that the injected refrigerant is heated.

In the present invention, the air conditioning system further comprises an injection pipe through which the injected refrigerant flows, a bypass pipe for connecting the injection pipe and a discharge pipe of the compressor, and a bypass valve disposed on the bypass pipe, and if it is judged that a liquid refrigerant is included in the injected refrigerant, the control unit may control the bypass valve to be opened so that the refrigerant bypassed from the compressor heats the refrigerant injected into the compressor.

In the present invention, the air conditioning system further comprises an injection pipe through which the injected refrigerant flows and a heater disposed on the injection pipe, and if it is judged that a liquid refrigerant is included in the injected refrigerant, the control unit may operate the heater to heat the injected refrigerant.

In the present invention, the air conditioning system further comprises an injection pipe through which the injected refrigerant flows and an insulating member disposed so as to cover at least part of the injection pipe.

In the present invention, the compressor is a capacity variable compressor, and if it is judged that a liquid refrigerant is included in the injected refrigerant, the control unit may control the frequency of the compressor to reduce the discharge flow rate of the compressor.

In the present invention, the air conditioning system further comprises: a first expansion device for throttling the refrigerant introduced from the condenser; a phase separator for separating the phase of the refrigerant introduced from the first expansion device; and a second expansion device for throttling the liquid refrigerant coming form the phase separator and supplying the same to the evaporator, and if it is judged that a liquid refrigerant is included in the injected refrigerant, the control unit may decrease the opening degree of the first expansion device or increase the opening degree of the second expansion device.

In the present invention, the air conditioning system further comprises: a first phase separator disposed between the condenser and the evaporator, and for introducing the refrigerant flown out from the condenser after being throttled, and separating the phase of the introduced refrigerant; and a second phase separator for separating the phase of the refrigerant introduced from the gaseous discharge pipe of the first phase separator.

In the present invention, the air conditioning system further comprises a phase separator disposed between the condenser and the evaporator, and for introducing the refrigerant flown out from the condenser after being throttled, and separating the phase of the introduced refrigerant, the phase separator comprising: a body; an inlet pipe disposed at the body and for introducing the refrigerant passed through the condenser; a gaseous discharge pipe and a liquid discharge pipe which are inserted and disposed within the body, and for discharging the gaseous refrigerant and liquid refrigerant, respectively, separated from the refrigerant stored within the body; and a refrigerant pipe opening and closing part for opening and closing the gaseous discharge pipe with the rise and fall of the stream surface of the liquid refrigerant stored within the body. The refrigerant pipe opening and closing part comprises: a horizontal member disposed between the stream surface and the body; and an elastic member disposed between the horizontal member and the body, and if the stream surface is lower than a set level, elastically pushing the horizontal member downward in order to prevent the horizontal member from closing the gaseous discharge pipe and, if the stream surface exceeds a set level, closing the gaseous discharge pipe.

In the present invention, the compressor comprises a first compressing part for compressing the refrigerant passed through the evaporator and a second compressing part for compressing the refrigerant passed through the first compressing part and the injected refrigerant.

According to another aspect of the present invention, there is provided an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor having a first compressing part for compressing the refrigerant passed through the evaporator and a second compressing part for compressing both of the refrigerant passed through the first compressing part and a refrigerant injected after branched between the first expansion device and the second expansion device; an injection valve for adjusting the amount of refrigerant injected into the second compressing part; and a control unit for, if it is judged that a liquid refrigerant is included in the injected refrigerant, controlling the injection valve to be closed.

According to still another aspect of the present invention, there is provided an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor having a first compressing part for compressing the refrigerant passed through the evaporator and a second compressing part for compressing both of the refrigerant passed through the first compressing part and a refrigerant injected after branched between the first expansion device and the second expansion device; an injection valve for adjusting the amount of refrigerant injected into the second compressing part; and a control unit for, if it is judged that a liquid refrigerant is included in the injected refrigerant, controlling that the injected refrigerant is heated.

In the present invention, as described above, it is possible to prevent that a liquid refrigerant is included in a refrigerant injected into a compressor. Accordingly, the risk of liquid compression of the compressor is greatly reduced, thereby decreasing the possibility of damage to the compressor and improving reliability and performance.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

An air conditioning system includes general residential cooling air conditioner for performing a cooling operation only, a heating air conditioner for performing a heating operation only, a heat pump type air conditioner for performing both cooling and heating operations, and a multi-type air conditioner for cooling and heating a plurality of indoor spaces. Hereinafter, as one example of the air conditioning system, a heat pump type air conditioner (hereinafter, referred to as "air conditioner") will be described in details.

Hereinafter, embodiments of the present invention will be described below with reference to the accompanying drawings.

Figure 1:
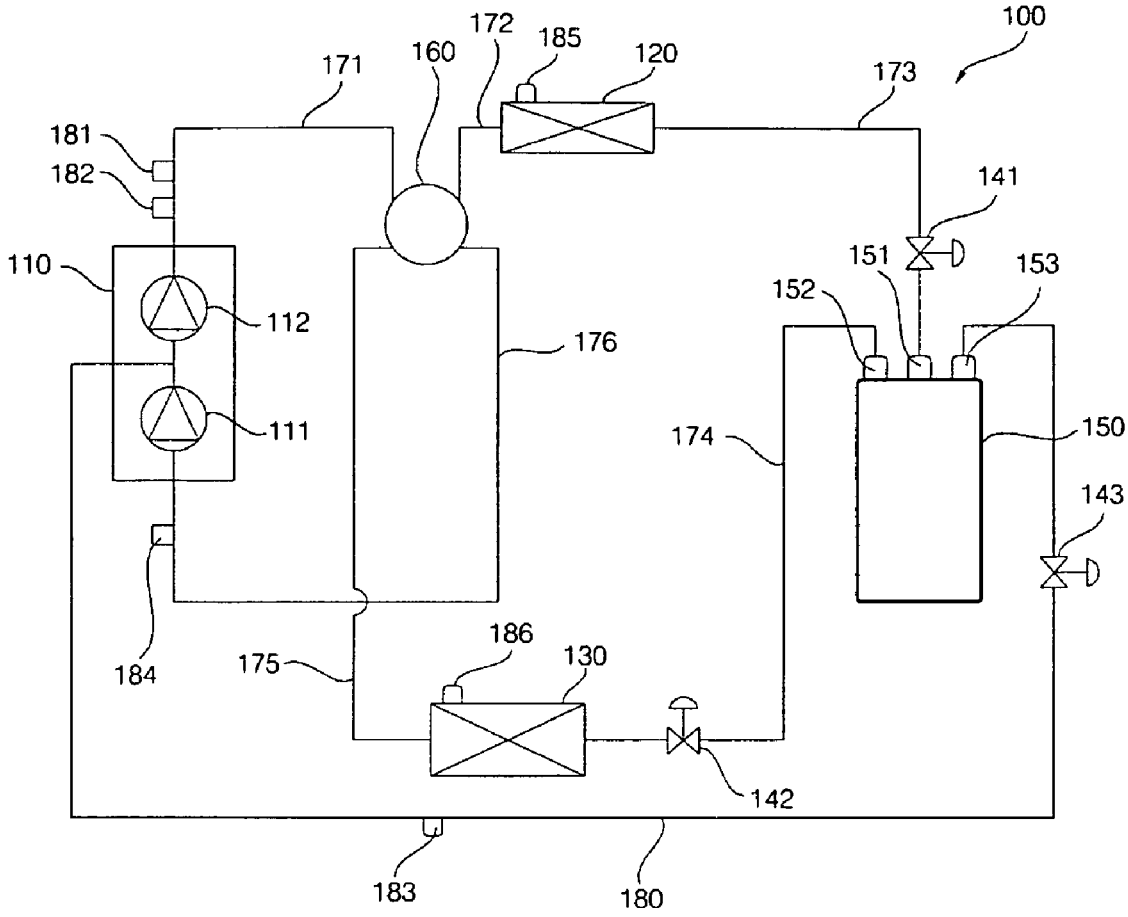
FIG. 1 is a view showing the construction of an air conditioner in accordance with a first embodiment of the present invention.
Figure 2:
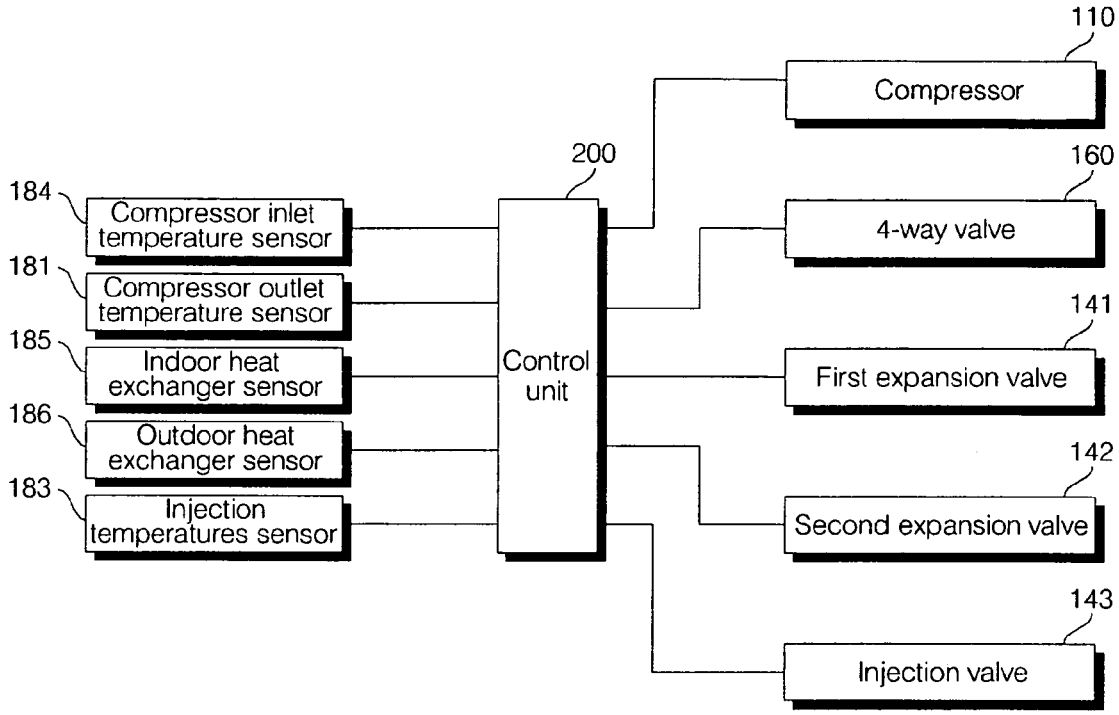
FIG. 2 is a block diagram showing a control flow of the air conditioner.

FIG. 1 is a view showing the construction of an air conditioner 100 in accordance with a first embodiment of the present invention. FIG. 2 is a block diagram showing a control flow of the air conditioner 100.

Referring to FIGS. 1 and 2, the air conditioner 100 includes a compressor 110, an indoor heat exchanger 120, an outdoor heat exchanger 130, a first expansion valve 141, a second expansion valve 142, a phase separator 150, and a 4-way valve 160. The indoor heat exchanger 120 functions as an evaporator in a cooling operation and functions as a condenser in a heating operation. The compressor 110 compresses an introduced refrigerant of low temperature and low pressure into a refrigerant of high temperature and high pressure. The compressor 110 includes a first compressing part 111 and a second compressing part 112. The first compressing part 111 compresses the refrigerant introduced from the evaporator, and the second compressing part 112 mixes and compresses the refrigerant coming from the first compressing part 111 and the refrigerant injected by being branched between the evaporator and the condenser. However, the present invention is not limited thereto, and the compressor 110 can have a multi-layered structure more than three layers.

The 4-way valve 160 is a flow path switching valve for switching the flow of refrigerant upon cooling and heating, and guides the refrigerant compressed in the compressor 110 to the outdoor heat exchanger 130 upon cooling and guides the same to the indoor heat exchanger 120 upon heating. The 4-way valve 160 and the compressor 110 are connected via a first connecting pipe 171. A compressor outlet temperature sensor 181 and a discharge pressure sensor 182 are disposed on the first connecting pipe 171 in order to measure the discharge temperature and pressure of the refrigerant discharged from the compressor 110. The indoor heat exchanger 120 is disposed in a room, and is connected to the 4-way vale 160 via a second connecting pipe 172. An indoor heat exchanger sensor 185 is installed at the indoor heat exchanger 120.

The phase separator 150 separates an introduced refrigerant into a gaseous refrigerant and a liquid refrigerant, sends the liquid refrigerant to the evaporator, and sends the gaseous refrigerant to the second compressing part 112. A first connecting part 151 of the phase separator 150 and the indoor heat exchanger 120 are connected via a third connecting pipe 173. The first connecting part 151 serves as a liquid refrigerant discharge pipe in a cooling operation and serves as a refrigerant inlet pipe in a heating operation.

The first expansion valve 141 is disposed on the third connecting pipe 173, and serves as a second expansion device for throttling the liquid refrigerant introduced from the phase separator 150 in a cooling operation and serves as a first expansion device for throttling the liquid refrigerant introduced from the indoor heat exchanger 120 in a heating operation.

The outdoor heat exchanger 130 is disposed outdoors, and is connected to a second connecting part 152 of the phase separator 150 via a fourth connecting pipe 174. An outdoor heat exchanger sensor 186 is installed at the outdoor heat exchanger 130. The second connecting pipe serves as a refrigerant inlet pipe in a cooling operation and serves as a liquid refrigerant discharge pipe in a heating operation.

The second expansion valve 142 is disposed on the fourth connecting pipe 174, and serves as a first expansion device for throttling the liquid refrigerant introduced from the heat exchanger 130 in a cooling operation and serves as a second expansion device for throttling the liquid refrigerant introduced from the phase separator 150 in a heating operation.

The outdoor heat exchanger 130 is connected to the four-way valve via a fifth connecting pipe 175. Also, the 4-way valve 160 and an inlet pipe of the compressor 110 are connected via a sixth connecting pipe 176. A compressor inlet temperature sensor 184 for measuring the temperature of the inlet side of the compressor 110 is disposed on the sixth connecting pipe 176.

The second compressing part 112 is connected to a third connecting part 153 of the phase separator 150 via an injection pipe 180. The third connecting pipe 153 is used as a gaseous refrigerant discharge pipe in cooling and heating operations.

An injection valve 143 is disposed on the injection pipe 180. The injection valve 143 controls the amount and pressure of the refrigerant injected into the second compressing part 112 from the phase separator 150. When the injection pipe 180 is opened, the gaseous refrigerant in the phase separator 150 is introduced into the second compressing part 112 through the injection pipe 180. An injection temperature sensor 183 for measuring the temperature of the refrigerant being injected is disposed on the injection pipe 180.

The opening degree of the first and second expansion valves 141 and 142 and the injection valve 143 is controlled by a control unit 200 for controlling the operation of the air conditioner.

Figure 3:
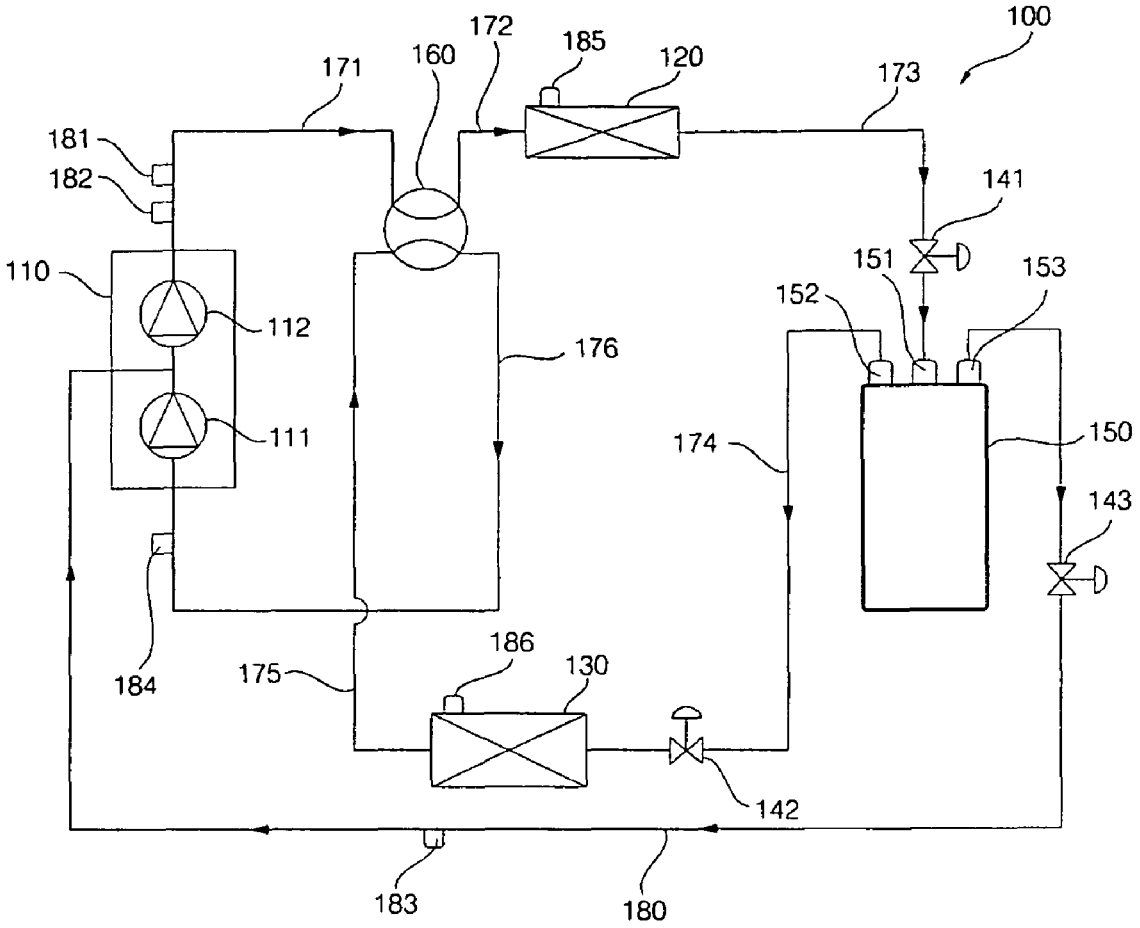
FIG. 3 illustrates the flow of refrigerant in the heating operation of the air conditioner.

FIG. 3 illustrates the flow of refrigerant in the heating operation of the air conditioner.

Referring to FIG. 3, a gaseous refrigerant of high temperature and high pressure discharged from the compressor 110 is introduced into the indoor heat exchanger 120 via the 4-way valve 160. In the indoor heat exchanger 120, the gaseous refrigerant is condensed by heat exchange with indoor air. The condensed refrigerant is throttled in the first expansion valve 141, and then introduced into the phase separator 150. The liquid refrigerant separated by the phase separator 150 is throttled again in the second expansion valve 142, and then introduced into the outdoor heat exchanger 130. The refrigerant in the outdoor heat exchanger 130 is evaporated by heat exchange with ambient air, and the evaporated refrigerant is introduced into the first compressing part 111.

If there is a request for performing gas injection during the heating operation, the control unit 200 opens the injection valve 143. As the injection valve 143 is opened, the gaseous refrigerant separated in the phase separator 150 is injected into the second compressing part 112 through the injection pipe 180. In the second compressing part 112, the injected refrigerant and the refrigerant coming from the first compressing part 111 are mixed and then compressed. The refrigerant compressed in the second compressing part 112 circulates again to the 4-way valve 160.

Figure 4:
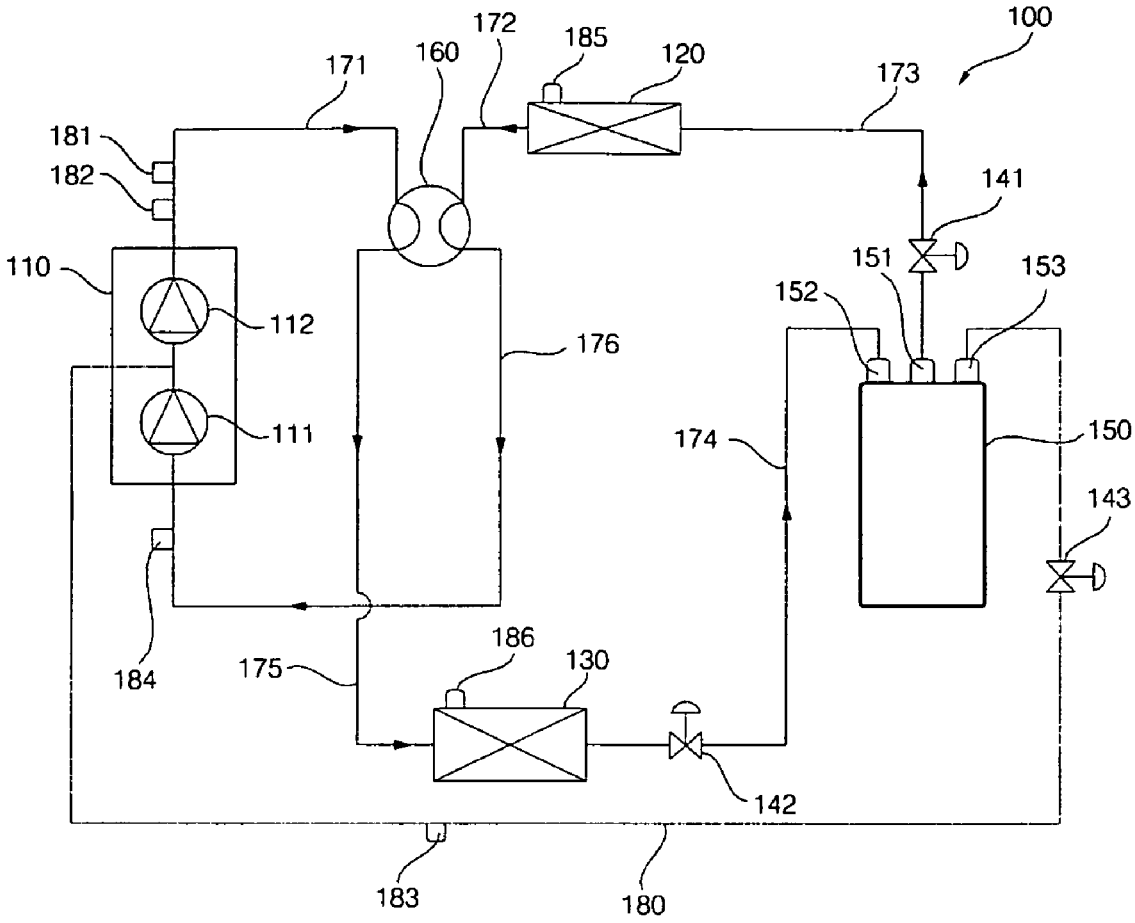
FIG. 4 illustrates the flow of refrigerant in the cooling operation of the air conditioner.

FIG. 4 illustrates the flow of refrigerant in the cooling operation of the air conditioner.

Referring to FIG. 4, a gaseous refrigerant of high temperature and high pressure discharged from the compressor 110 is introduced into the outdoor heat exchanger 130 via the 4-way valve 160. In the outdoor heat exchanger 130, the gaseous refrigerant is condensed by heat exchange with indoor air. The condensed refrigerant is throttled in the second expansion valve 142, and then introduced into the phase separator 150. The liquid refrigerant separated by the phase separator 150 is throttled again in the first expansion valve 141, and then introduced into the indoor heat exchanger 120. The refrigerant in the indoor heat exchanger 120 is evaporated by heat exchange with ambient air, and the evaporated refrigerant is introduced into the first compressing part 111. If there is no request for performing gas injection during the cooling operation, the control unit 200 closes the injection valve 143, thus keeping the gaseous refrigerant coming from the phase separator 150 from being injected into the second compressing part 112. However, the present invention is not limited thereto, and in the cooling operation, too, the gaseous refrigerant coming from the phase separator 150 may be injected into the second compressing part 112.

A method of controlling an air conditioner in accordance with the first embodiment of the present invention will be described below.

If a user drives the air conditioner 100 in order to cool and heat an indoor space, the control unit 200 detects a driving command.

When the driving command is detected, the control unit 200 initializes the first and second expansion valves 141 and 142 and the injection valve 143. The control unit 200 fully opens the first and second expansion valves 141 and 142, and closes the injection valve 143. By closing the injection valve 143, a liquid refrigerant can be kept from being introduced into the compressor 110 at an initial stage of driving.

Once the initialization of the first and second expansion valves and the injection valve 143 is finished, the control unit controls the opening amounts of the first expansion valve 141 and the second expansion valve 142 in a different control method from each other among a plurality of control methods. The plurality of control methods include an intermediate pressure control method in which the opening amount of the first expansion device for throttling the refrigerant coming from the condenser 150 and introduced into the phase separator 150 is adjusted so as to make the refrigerant reach a preset intermediate pressure and a superheat degree control method in which the opening amount of the second expansion valve for throttling the refrigerant coming from the condenser 150 and introduced into the phase separator 150 is adjusted so as to make the refrigerant reach a preset target degree of superheat.

When the air conditioner 100 is in a heating operation mode, the first expansion valve 141 serves as the first expansion valve and the second expansion valve 142 serves as the second expansion valve. Thus, in the heating operation mode, the control unit 200 controls the first expansion valve 141 in the intermediate control method and controls the second expansion valve 142 in the superheat degree control method. On the other hand, when the air conditioner 100 is in a cooling operation mode, the first expansion valve t 141 serves as the second expansion valve and the second expansion valve 142 serves as the first expansion valve. Thus, the first expansion valve 141 is controlled in the superheat degree control method, and the second expansion valve 142 is controlled in the intermediate pressure control method.

In the intermediate pressure control method, a value of at least one of operating parameters is detected, and target opening degrees of the valves are determined based on a stored set value corresponding to the detected value of the operating parameter. The operating parameters are a plurality of operating parameters. The operating parameters may include the operability of gas injection in which refrigerant is injected into the second compressing part 112, the frequency of the compressor 110, the indoor temperature of the air conditioner 100, an outdoor temperature, the difference between the indoor and outdoor temperatures, the discharge pressure of the compressor 110, the discharge temperature of the compressor 110, and so forth. The set values for the operating parameters are preset and stored in a table format in the control unit 200. The set value for the frequency of the compressor 110 is set differently according to the operability of gas injection. In other words, the set value for the frequency of the compressor 110 is set differently according to whether the injection valve 143 is opened or not. The target opening degrees of the valves may be obtained by combination, such as addition and multiplication, of the set values.

In the superheat degree control method, the degree of superheat of a refrigerant is measured in real time, and the opening amounts of the valves are controlled based on the measured degree of superheat. The degree of superheat of a refrigerant may be measured by the outdoor heat exchanger sensor 186 installed at the outdoor heat exchanger 130 and the compressor inlet temperature sensor 184. A fuzzy table is stored in the control unit 200 on the basis of a difference between a measured degree of superheat and a preset target degree of superheat and a change in difference, and the opening amounts of the valves are determined from the fuzzy table.

Figure 5:
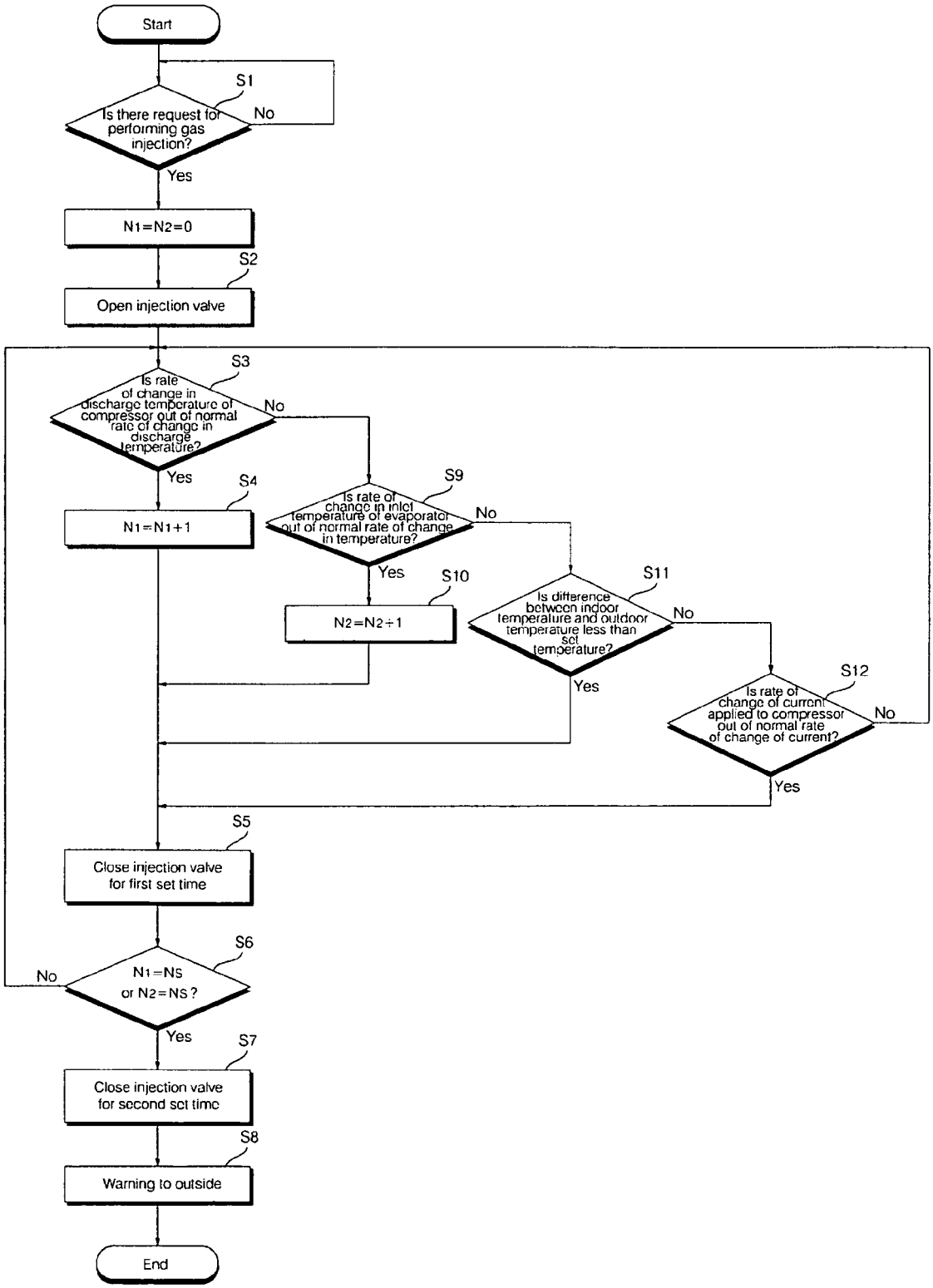
FIG. 5 is a sequential view illustrating a control method for an injection valve of the air conditioner as shown in FIG. 1.

FIG. 5 is a sequential view illustrating a control method for an injection valve of the air conditioner as shown in FIG. 1

Referring to FIG. 5, if there is a request for performing gas injection, the control unit 200 opens the injection valve 143 (S2). The control unit 200 opens the opening degree of the injection valve 143 in stages until a target opening degree is reached. Once the injection valve 143 is opened, a gaseous refrigerant separated in the phase separator 150 is injected into the second compressing part 112.

When a gaseous refrigerant is injected into the second compressing part 112, the control unit 200 judges whether a liquid refrigerant is included in the injected refrigerant or not.

In this embodiment, if at least one of operating parameters of the air conditioner 100 is out of a preset normal operating range, the control unit 200 judges that a liquid refrigerant is included in the injected refrigerant. Once a liquid refrigerant is injected into the compressor 110, liquid compression occurs in the compressor 110. When liquid compression occurs, at least one of operating parameters is out of the preset normal operating range. The operating parameters include the discharge temperature and discharge pressure of the compressor 110, the inlet side temperature of the evaporator, the indoor temperature and outdoor temperature of the air conditioning system 100, and the current applied to the compressor 110, and it is judged from a change in the operating parameters whether a liquid refrigerant is included in the injected refrigerant or not.

Referring to FIG. 5, first, the discharge temperature of the second compressing part 112 is detected, and it is judged whether the range of change in discharge temperature is out of a preset normal rate of change in discharge temperature (S3). That is, it is judged whether the discharge temperature drops by more than a set temperature within a set time or not. In one example, if the discharge temperature falls by 15 degrees within three minutes, it is judged that the discharge temperature is out of the normal rate of change and liquid compression occurs in the compressor 110. Here, drops in the discharge temperature caused by the turn-off of the compressor 110 or a drop in the frequency of the compressor 110 may be excluded.

If the rate of change in the discharge temperature of the second compressing part 112 is out of the normal rate of change in discharge temperature, the control unit 200 closes the injection valve 143 for a first set time (S5). The first set time may be obtained by an experiment or the like. The closure of the injection valve 143 by the control unit 200 can prevent a liquid refrigerant from being injected into the second compressing part 112 from the phase separator 150. And, the number N1 of times of abnormality in discharge temperature by which the rate of change in discharge temperature is out of the normal rate of change in discharge temperature is accumulated and added (S4).

If the number N1 of times of abnormality in the discharge temperature of the second compressing part 112 is more than a set number Ns of times (S6), the control unit 200 closes the injection valve 143 for a second set time (S17). The second set time may be longer than the first set time. Thus, in a case where the discharge temperature of the second compressing part 112 is frequently out of the normal operating range, it is possible to ensure sufficient time for the stabilization of the cycle by increasing the time for closing the injection valve 143.

Moreover, in a case where the discharge temperature of the second compressing part 112 is frequently out of the normal operating range, this can be informed to the outside by a warning message or a warning sound.

If the rate of change in the discharge temperature of the second compressing part 112 is within the normal rate of change in discharge temperature, the inlet side temperature of the evaporator is detected to judge whether the rate of change in the inlet side temperature of the evaporator is out of a preset normal rate of change in evaporator temperature or not (S9). That is, it is judged whether the inlet side temperature of the evaporator drops by more than a set temperature within a set time or not. Here, it is preferable to detect the inlet side temperature of the evaporator after the cycle is stabilized after the passage of a predetermined time since the driving of the evaporator 110.

If the rate of change in the inlet side temperature of the evaporator is out of the normal rate of change in evaporator temperature, the control unit 200 closes the injection valve 143 for a first set time. The closure of the injection valve 143 can prevent a liquid refrigerant from being injected into the second compressing part 112 from the phase separator 150. And, the number N2 of times of abnormality in evaporator temperature by which the rate of change in the inlet side temperature of the evaporator is out of the normal rate of change in evaporator temperature is stored, accumulated, and added (S10).

If the number N2 of times of abnormality in evaporator temperature is more than a set number Ns of times (S6), the control unit 200 closes the injection valve 143 for a second set time (S7). The second set time may be longer than the first set time. Thus, in a case where the temperature of the evaporator is frequently out of the normal operating range, it is possible to ensure sufficient time for the stabilization of the cycle by increasing the time for closing the injection valve 143.

Moreover, in a case where the temperature of the evaporator is frequently out of the normal operating range, this can be informed to the outside by a warning message or a warning sound.

Meanwhile, if it is judged that the rate of change in the inlet side temperature of the evaporator is within the normal rate of change in evaporator temperature, the difference between the indoor temperature and outdoor temperature of the air conditioner 100 is calculated, and it is judged whether the difference is less than a preset temperature or not (S11).

If the difference between the indoor temperature and the outdoor temperature is less than the set temperature, this indicates that the cycle runs abnormally or the load of the air conditioner 100 is very small. When the load of the air conditioner 100 is very small, the injection of a gaseous refrigerant is unnecessary. If unnecessary injection is performed, a liquid refrigerant may be introduced into the compressor 110. Therefore, the control unit 200 closes the injection valve 143 for the first set time to temporally stop the injection of refrigerant.

Meanwhile, if the difference between the indoor temperature and outdoor temperature of the air conditioner 100 is greater than the set temperature, the control unit 200 detects the rate of change of current applied to the compressor 110.

It is judged whether the rate of change of current applied to the compressor 110 is out of a preset normal rate of change of current. That is, if the current applied to the compressor 110 increases by more than a preset value within a set time, it is judged that liquid compression has occurred and, thus, the work of the compressor has increased. Therefore, the control unit 200 closes the injection valve 143 for the first set time to temporally stop the injection of refrigerant.

Subsequently, when it is judged that a liquid refrigerant is included in an injected refrigerant, the control unit 200, the control unit 200 temporally stops the injection of refrigerant, thereby preventing liquid compression from occurring in the compressor 110.

Meanwhile, if it is judged that a liquid refrigerant is included in an injected refrigerant, the control unit 200 can reduce the frequency of the compressor 110 and thus reduce the discharge flow rate of the compressor 110. The higher the stream surface of the liquid refrigerant in the phase separator 150, the higher the possibility of the liquid refrigerant being introduced into the second compressing part 112 through a gaseous discharge pipe and the injection pipe 180. When the discharge flow rate of the compressor 110 decreases, the flow rate of the refrigerant introduced into the phase separator 150 decreases, thereby lowering the stream surface of the liquid refrigerant in the phase separator 150. Therefore, the possibility of the liquid refrigerant being injected into the second compressing part 112 may be greatly decreased.

Additionally, the stream surface of liquid in the phase separator 150 may be lowered in the following method as well. If the opening degree of a liquid discharge pipe of the phase separator 150 is increased and the opening degree of a refrigerant inlet pipe is decreased, the amount of a liquid refrigerant in the phase separator 150 decreases, thereby decreasing the stream surface of liquid. In a heating operation, the opening degree of the first expansion valve 141 is decreased, and the opening degree of the second expansion valve 142 is increased. In a cooling operation, the opening degree of the first expansion valve 141 is increased, and the opening degree of the second expansion valve 142 is decreased. Alternatively, a water level detection sensor (not shown) may be disposed at the phase separator 150 to thus judge whether or not a liquid refrigerant is flown out from the phase separator 150 through a gaseous discharge pipe on the basis of a signal received from the water level detection sensor.

Hereinafter, an air conditioner in accordance with a second embodiment of the present invention will be described. The following description focuses on the difference with the first embodiment. The same reference numerals as those in the first embodiment denote the same members.

The difference with the first embodiment is that a liquid refrigerant detection sensor (not shown) for detecting whether a liquid refrigerant flows or not is disposed on the injection pipe 180. The control unit 200 can directly judge whether a liquid refrigerant is included in an injected refrigerant or not on the basis of data received from the liquid refrigerant detection sensor (not shown).

The control unit 200 can predict the phase of an injected refrigerant, as well as judging whether a liquid refrigerant is included in an injected refrigerant or not. Even if the compressor 110 finds out liquid compression being taken place at present, and solves the liquid compression of the compressor 110 using various methods, unrecoverable damage may occur to the compressor 110. Thus, it is very important to predict the possibility of liquid compression of the compressor 110. The control unit 200 can predict the introduction of a liquid refrigerant from data received from the liquid refrigerant detection sensor (not shown) by classifying the received data into a data range representing the introduction of a liquid refrigerant at present and a data range representing the prediction of the introduction of a liquid refrigerant in the future. In other words, the control unit 200 is able to predict the future introduction of a liquid refrigerant from the received data even though no liquid refrigerant is introduced at present.

Figure 6:
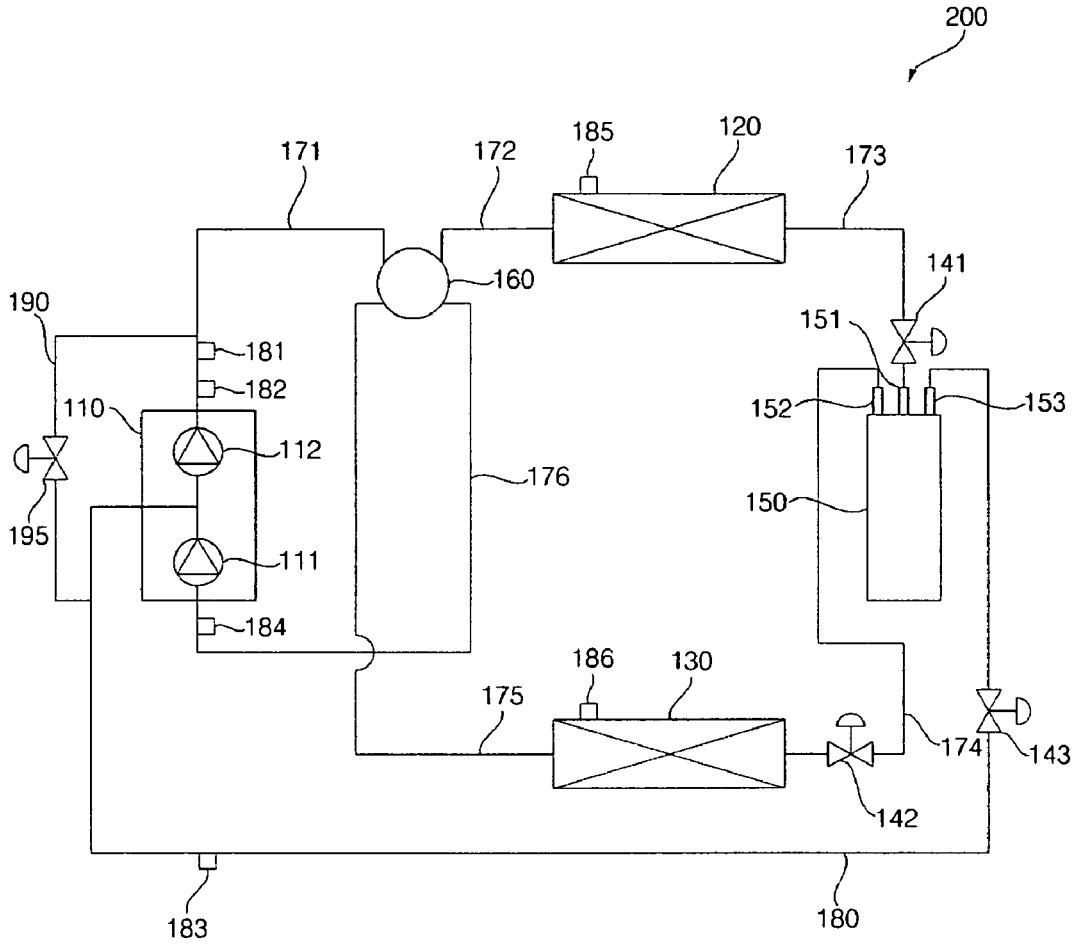
FIG. 6 is a configuration view illustrating an air conditioner in accordance with a third embodiment of the present invention.
Figure 7:
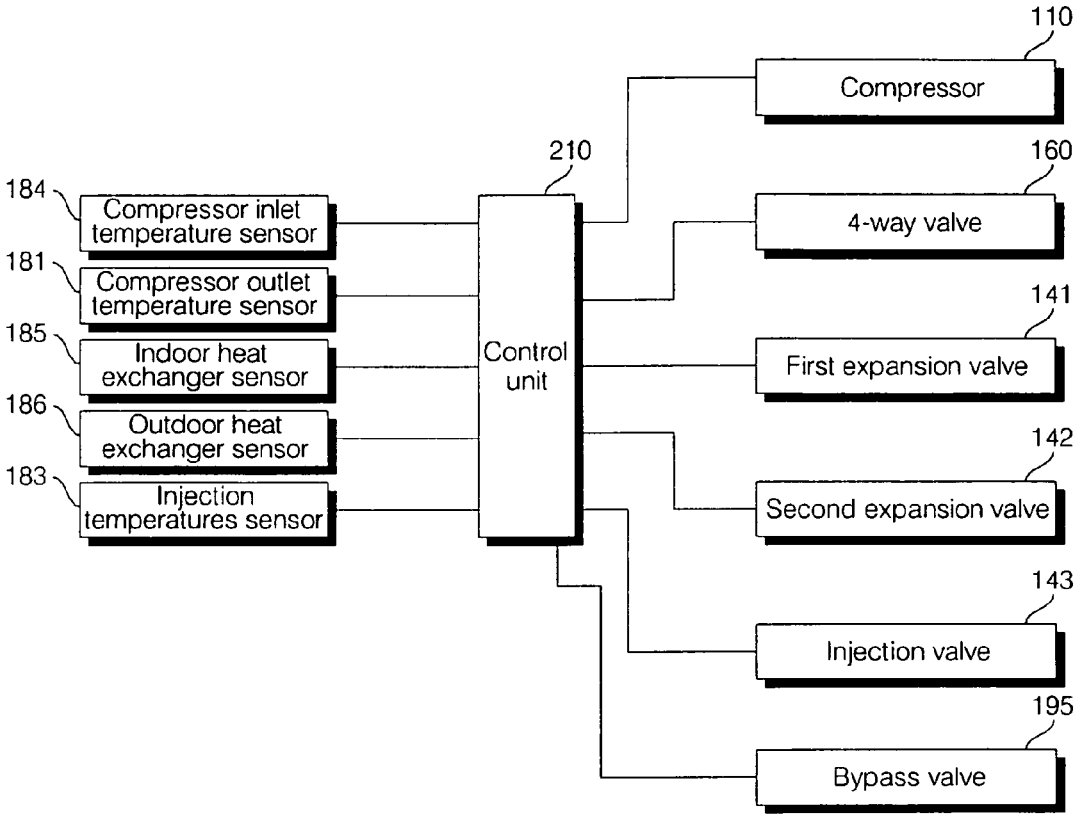
FIG. 7 is a block diagram showing a control flow of the air conditioner as shown in FIG. 6.

FIG. 6 is a construction view illustrating an air conditioner in accordance with a third embodiment of the present invention. FIG. 7 is a block diagram showing a control flow of the air conditioner as shown in FIG. 6. The following description focuses on the difference with the first embodiment. The same reference numerals as those in the first embodiment denote the same members.

The difference with the first embodiment is that prevention means for preventing a liquid refrigerant from being included in an injected refrigerant is included.

The prevention means includes a bypass pipe 190 for connecting a first connecting pipe 171 and an injection pipe 180 and a bypass valve 195 disposed on the bypass pipe 190.

A refrigerant in the first connecting pipe 171 is a high temperature refrigerant. When the bypass valve 195 is opened, the high temperature refrigerant in the first connecting pipe 171 is introduced into the injection pipe 180. Therefore, the temperature of the refrigerant on the injection pipe 180 increases so that the possibility of the refrigerant on the injection pipe 180 being condensed is prevented, thereby preventing a liquid refrigerant from being injected into the compressor 110 through the injection pipe 180. Especially, the control unit 210 adjusts the opening degrees of the injection valve 143 and the bypass valve 195 in consideration of the discharge temperature and discharge pressure of the compressor 110 and the temperature and flow rate of the injected refrigerant. However, the present invention is not limited thereto, and the injection valve 143 and the bypass valve 195 may not be control valves but simple on-off valves. Moreover, although the control unit 210 automatically manipulates the injection valve 143 and the bypass valve 195 in the above description, a user may manually manipulate the injection valve 143 and the bypass valve 195 by using an input device.

Figure 8:
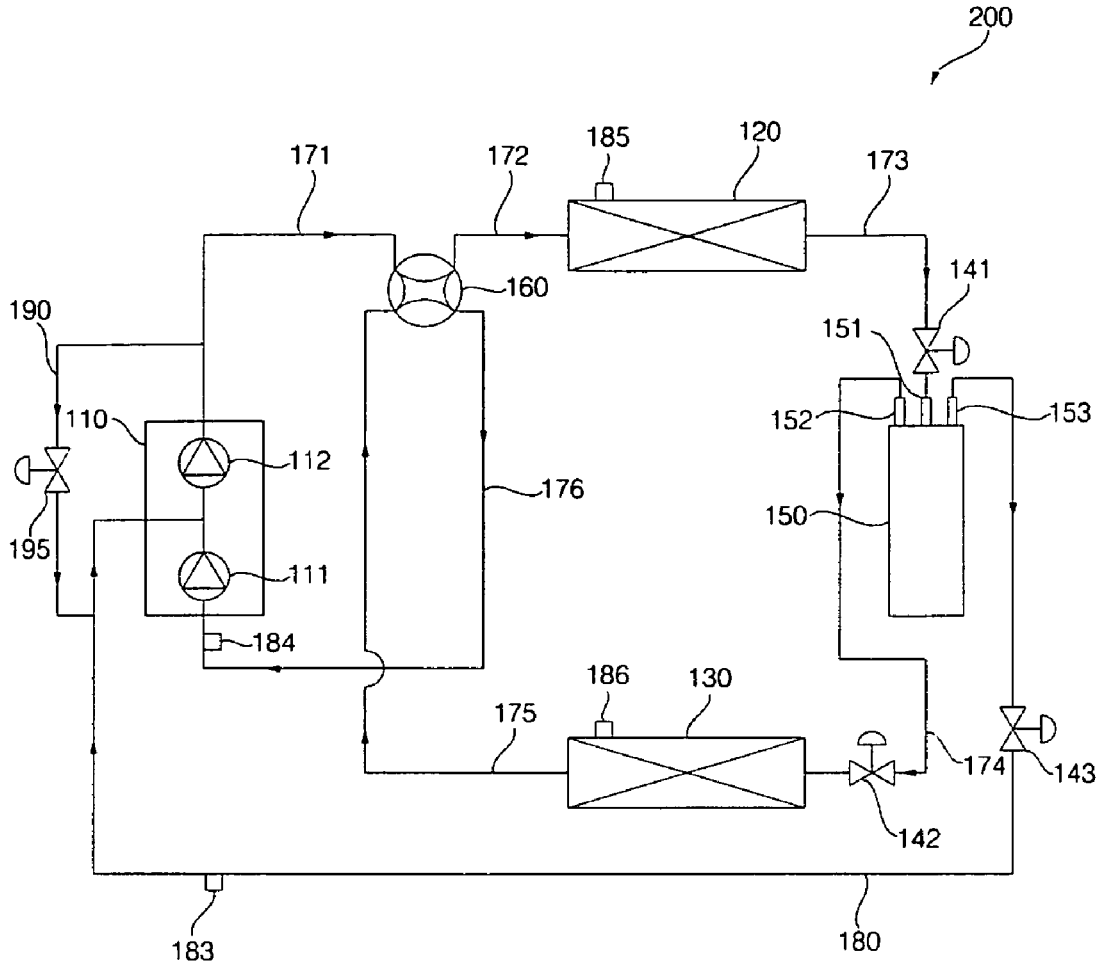
FIG. 8 is a configuration view illustrating the flow of refrigerant in a heating operation of the air conditioner as shown in FIG. 6.

FIG. 8 is a configuration view illustrating the flow of refrigerant in a heating operation of the air conditioner 200 as shown in FIG. 6.

Referring to FIG. 8, a gaseous refrigerant of high temperature and high pressure discharged from the compressor 110 is introduced into the indoor heat exchanger 120 via the 4-way valve 160. In the indoor heat exchanger 120, the gaseous refrigerant is condensed by heat exchange with indoor air. The condensed refrigerant is throttled in the first expansion valve 141, and then introduced into the phase separator 150. The liquid refrigerant separated by the phase separator 150 is throttled again in the second expansion valve 142, and then introduced into the outdoor heat exchanger 130. The refrigerant in the outdoor heat exchanger 130 is evaporated by heat exchange with ambient air, and the evaporated refrigerant is introduced into the first compressing part 111. As the injection valve 143 is opened, the gaseous refrigerant separated in the phase separator 150 is introduced into the second compressing part 112. Further, as the bypass valve 195 is opened, an injected refrigerant is heated and mixed, and then introduced into the second compressing part 112. The refrigerant discharged from the first compressing part 111 is mixed with the injected refrigerant, and then introduced into the second compressing part 112. Therefore, because the injected refrigerant is heated by a bypassed refrigerant of a high temperature, a liquid refrigerant is prevented from being included in the refrigerant introduced into the second compressing part 112, thereby greatly reducing the possibility of liquid compression of the compressor 110.

Figure 9:
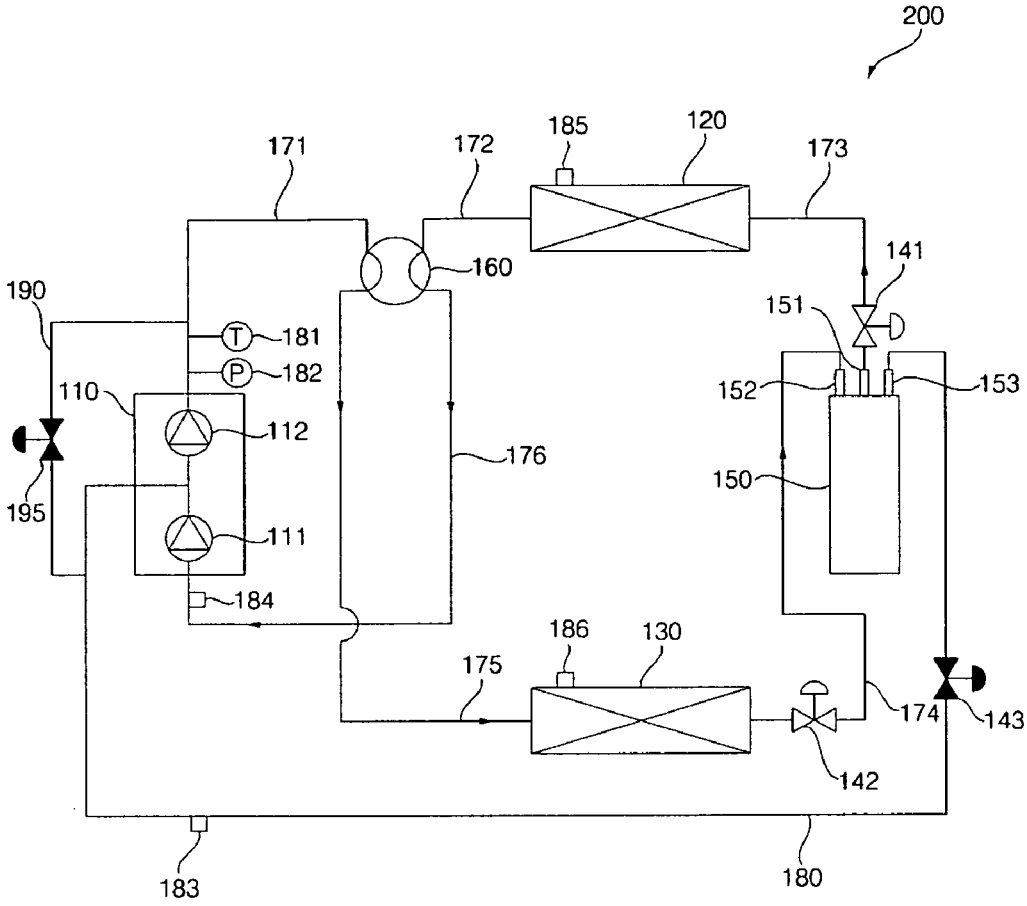
FIG. 9 is a configuration view illustrating the flow of refrigerant in a cooling operation of the air conditioner as shown in FIG. 6.

FIG. 9 is a configuration view illustrating the flow of refrigerant in a cooling operation of the air conditioner 200 as shown in FIG. 6.

Referring to FIG. 9, a gaseous refrigerant of high temperature and high pressure discharged from the compressor 110 is introduced into the outdoor heat exchanger 130 via the 4-way valve 160. In the outdoor heat exchanger 130, the gaseous refrigerant is condensed by heat exchange with indoor air. The condensed refrigerant is throttled in the second expansion valve 142, and then introduced into the phase separator 150. The liquid refrigerant separated by the phase separator 150 is throttled again in the first expansion valve 141, and then introduced into the indoor heat exchanger 120. The refrigerant in the indoor heat exchanger 120 is evaporated by heat exchange with ambient air, and the evaporated refrigerant is introduced into the first compressing part 111.

If there is no request for performing gas injection, the injection valve 143 and the bypass valve 195 are closed, thus keeping the refrigerant from being injected into the compressor 110. However, the present invention is not limited thereto, and in the cooling operation, the gaseous refrigerant from the phase separator 150 may be injected into the second compressing part 112. At this time, the bypass valve 195 may be opened, and thus a bypassed refrigerant may heat an injected refrigerant.

Figure 10:
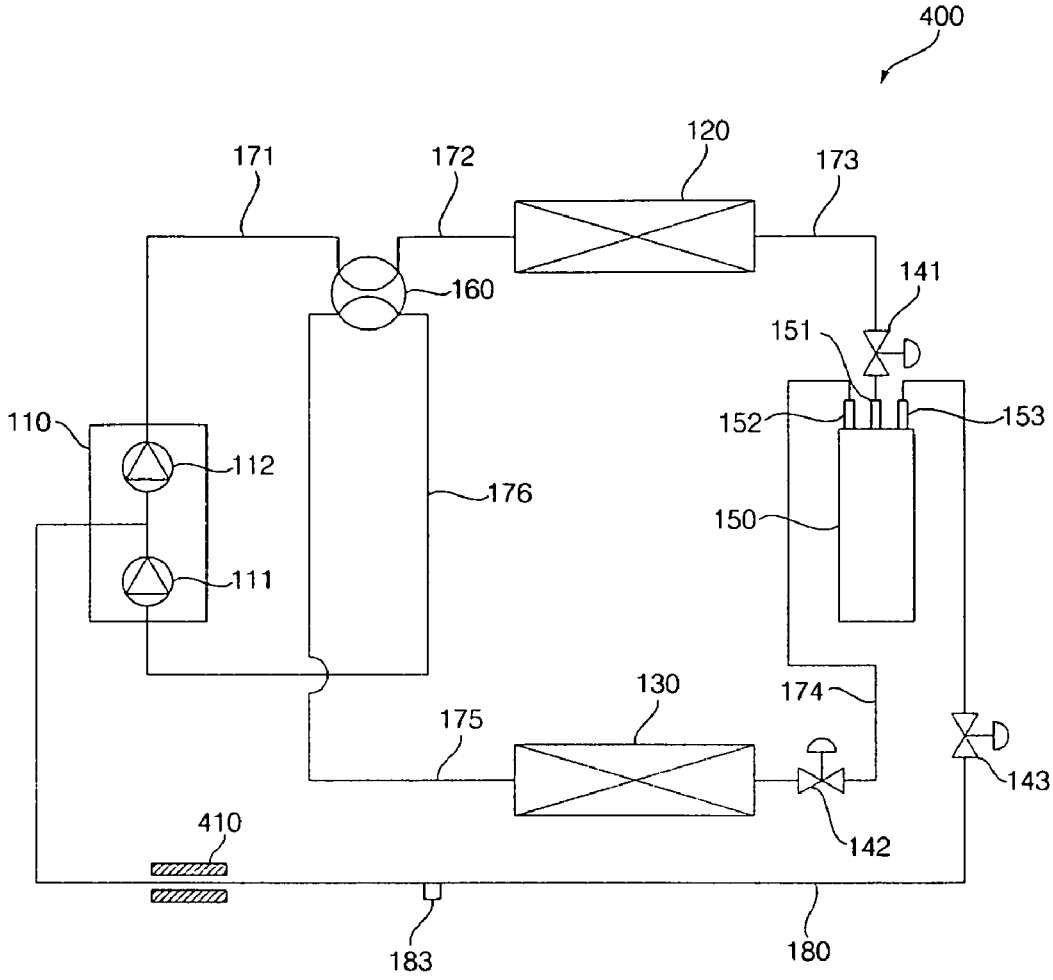
FIG. 10 is a configuration view of an air conditioner in accordance with a fourth embodiment of the present invention.

FIG. 10 is a configuration view of an air conditioner 400 in accordance with a fourth embodiment of the present invention. The following description focuses on the difference with the third embodiment. The same reference numerals as those in the third embodiment denote the same members.

The difference with the third embodiment is that prevention means does not include a bypass valve and a bypass valve but includes a heater 410 for heating a refrigerant injected through an injection pipe 180. The heater 410 operates before and after the opening of the injection valve 143. Upon initial opening of an injection valve 143, there is a possibility that a refrigerant introduced into a second compressing part 112 may not be stable, so that the heater 410 can start operation a predetermined time before the opening of the injection valve 143.

Figure 11:
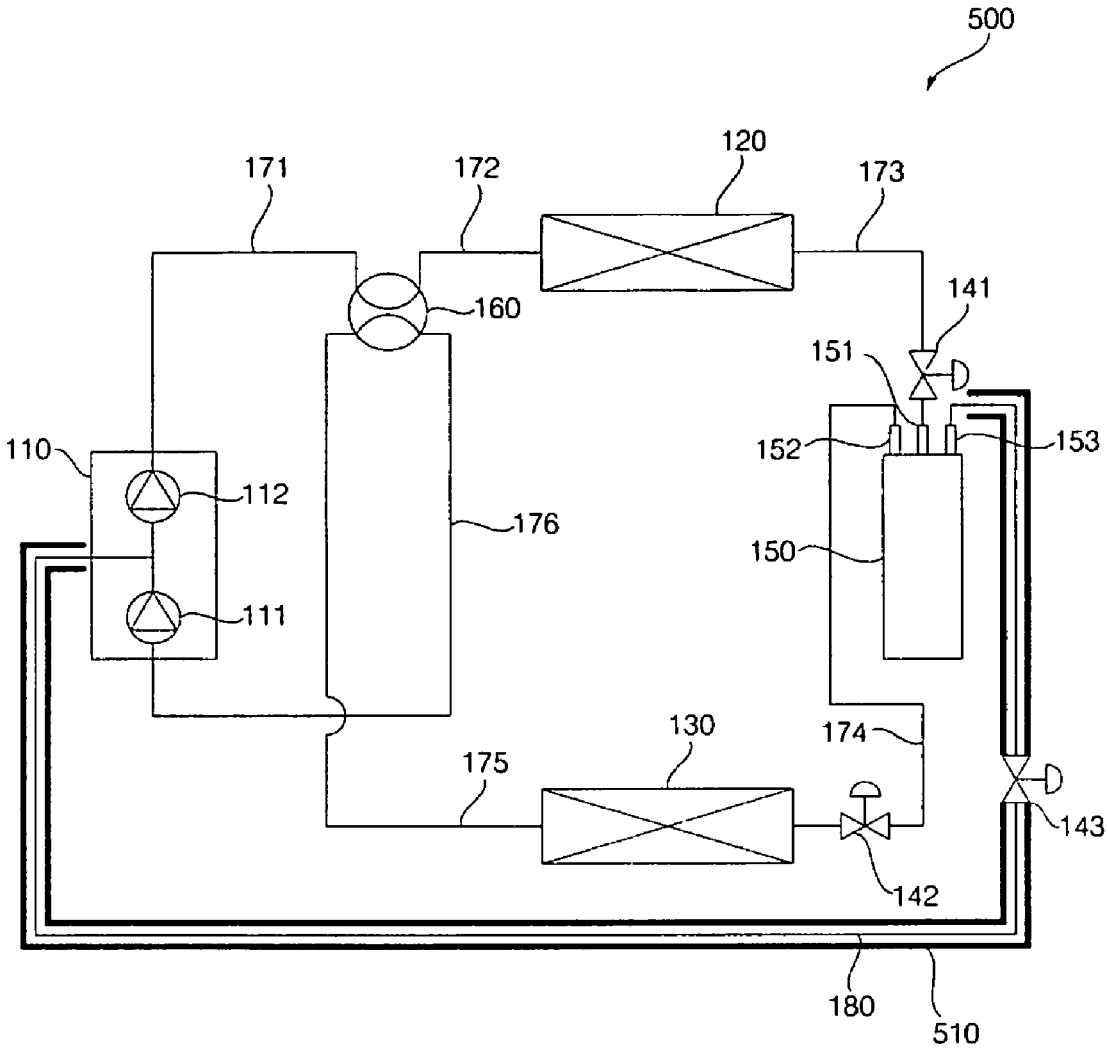
FIG. 11 is a configuration view of an air conditioner in accordance with a fifth embodiment of the present invention.

FIG. 11 is a configuration view of an air conditioner 500 in accordance with a fifth embodiment of the present invention. The following description focuses on the difference with the third embodiment. The same reference numerals as those in the third embodiment denote the same members.

The difference with the third embodiment is that prevention means does not include a bypass valve and a bypass valve but includes insulating means 510 covering an injection pipe 180. The insulating means 510 may surround only the portion where heat exchange with outside air is active, as well as entirely covering the injection pipe 180. As the insulating means 510, various members may be used, or a general insulating member may be used. Because heat exchange between an injected refrigerant and outside air is avoided by the insulating means 510, thereby preventing a phenomenon that a gaseous refrigerant is condensed by outside air. Therefore, the gaseous refrigerant may be introduced into a second compressing part 112 without being condensed. Especially, if the distance between a phase separator 150 and a compressor 110 is short, the injection of a liquid refrigerant may be prevented at a low cost.

Figure 12:
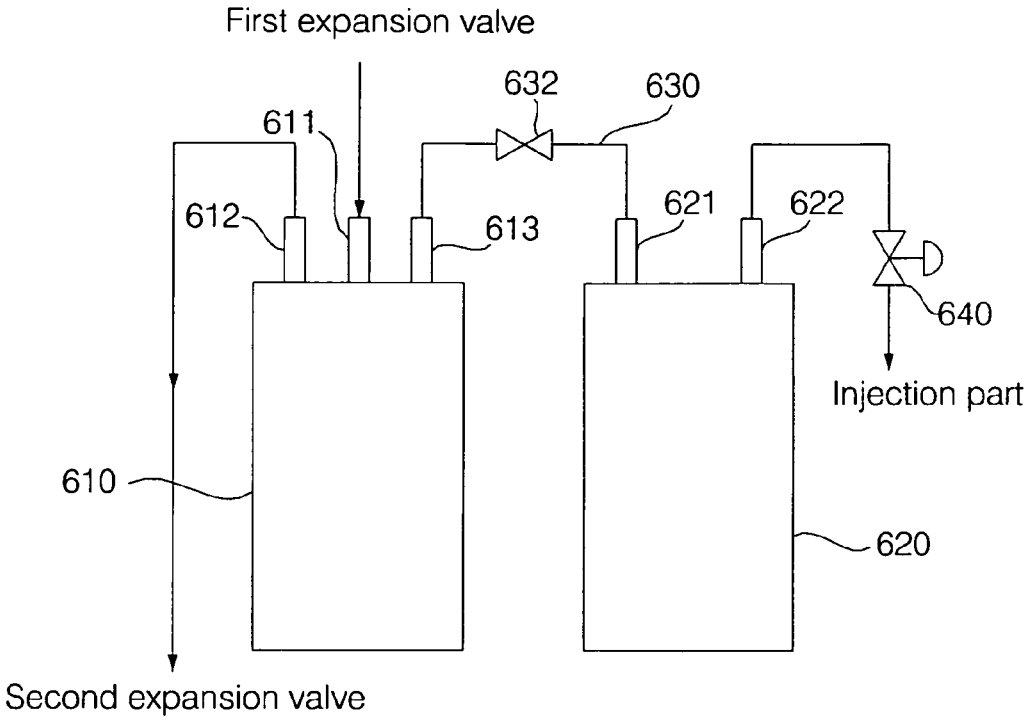
FIG. 12 is a configuration view of prevention means of an air conditioner in accordance with a sixth embodiment of the present invention, in which the flow of refrigerant in a heating operation is illustrated.
Figure 13:
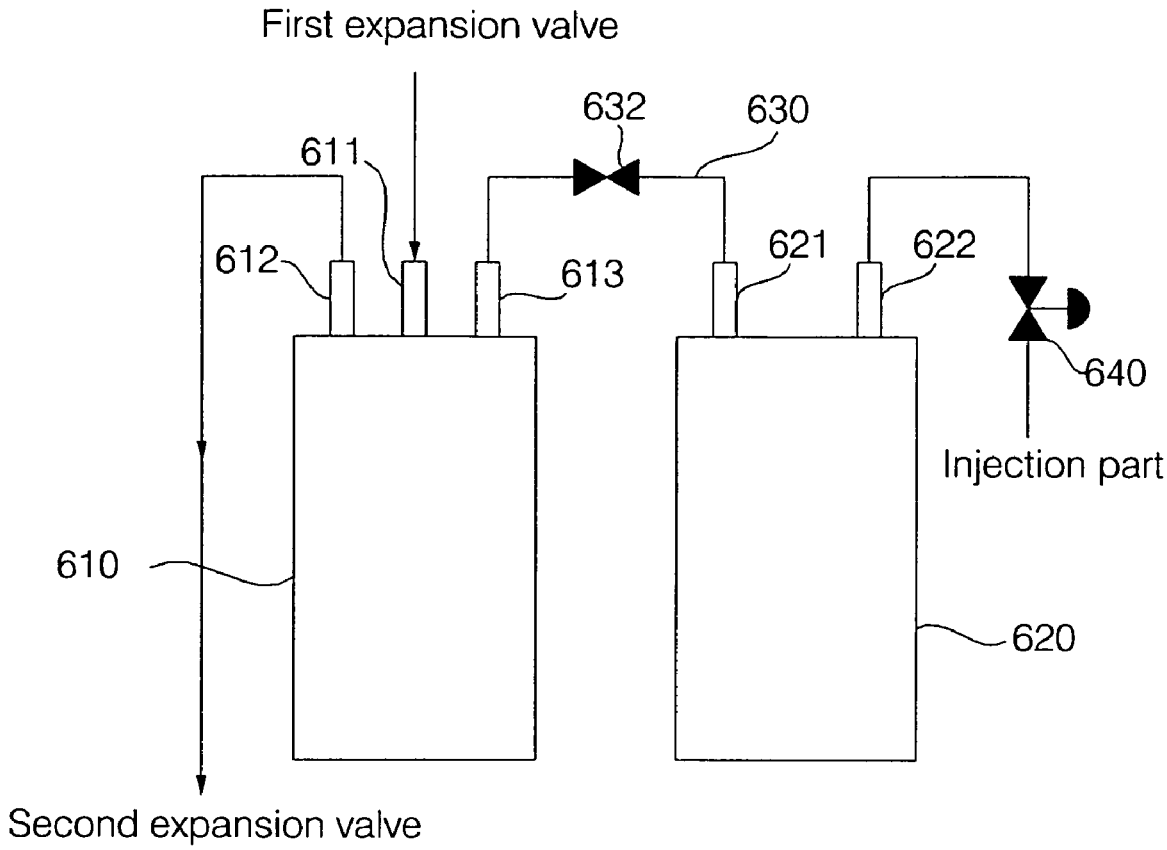
FIG. 13 is a configuration view illustrating the flow of refrigerant in a cooling operation in the prevention means of FIG. 12.

FIG. 12 is a configuration view of prevention means of an air conditioner in accordance with a sixth embodiment of the present invention, in which the flow of refrigerant in a heating operation is illustrated. FIG. 13 is a configuration view illustrating the flow of refrigerant in a cooling operation in the prevention means of FIG. 12.

Referring to FIGS. 12 and 13, prevention means includes a first phase separator 610 and a second phase separator 620. A third connecting part 613 of the first phase separator 610 and a first connecting part 621 of the second phase separator 620 are connected via an auxiliary connecting pipe 630. An auxiliary valve 632 is disposed so as to open and close the auxiliary connecting pipe 630.

Referring to FIG. 12, in a heating operation, a refrigerant passes through an indoor heat exchanger (not shown), and then is throttled in a first expansion valve (not shown) and introduced through a first connecting part 611 of the first phase separator 610. A liquid refrigerant separated in the phase separator 610 is flown out to a second expansion valve (not shown) through a second connecting pipe 612, throttled in the second expansion valve (not shown), and then introduced into an outdoor heat exchanger (not shown). As the auxiliary valve 632 is opened, a gaseous refrigerant separated in the first phase separator 61 is flown out through the third connecting part 613 and the auxiliary connecting pipe 630, and then introduced into the second phase separator 620 through the first connecting part 621 of the second phase separator 632. As an injection valve 640 is opened, the gaseous refrigerant separated in the second phase separator 620 is injected into a compressor (not shown) through a second connecting part 622. In the heating operation, the third connecting part 613 of the first phase separator 610 and the second connecting part 622 of the second phase separator 620 function as a gaseous discharge pipe, and the second connecting part 612 of the first phase separator 610 functions as a liquid discharge pipe. The first connecting part 611 of the first phase separator 610 functions as a refrigerant inlet pipe.

Accordingly, since the gaseous refrigerant firstly separated in the first phase separator 610 is secondly separated in the second phase separator 620 and injected into the compressor (not shown), the possibility of a liquid refrigerant being introduced into the compressor (not shown) is largely reduced. Especially, in a case where the stream surface of liquid of the first phase separator 610 is not stable, it is possible to fundamentally preventing the liquid refrigerant from being injected into the compressor (not shown) through the gaseous discharge pipe.

Referring to FIG. 13, in a cooling operation, the auxiliary valve 632 and the injection valve 640 are closed. Thus, a refrigerant is introduced from the second expansion valve (not shown) into the first phase separator 610 through the second connecting part 612 of the first phase separator 610, and then only a liquid refrigerant separated in the first phase separator 610 is flow out to the first expansion valve (not shown) through the first connecting part 611 of the first phase separator 610. The refrigerant is throttled in the first expansion valve (not shown), and then introduced into the indoor heat exchanger (not shown).

Figure 14:
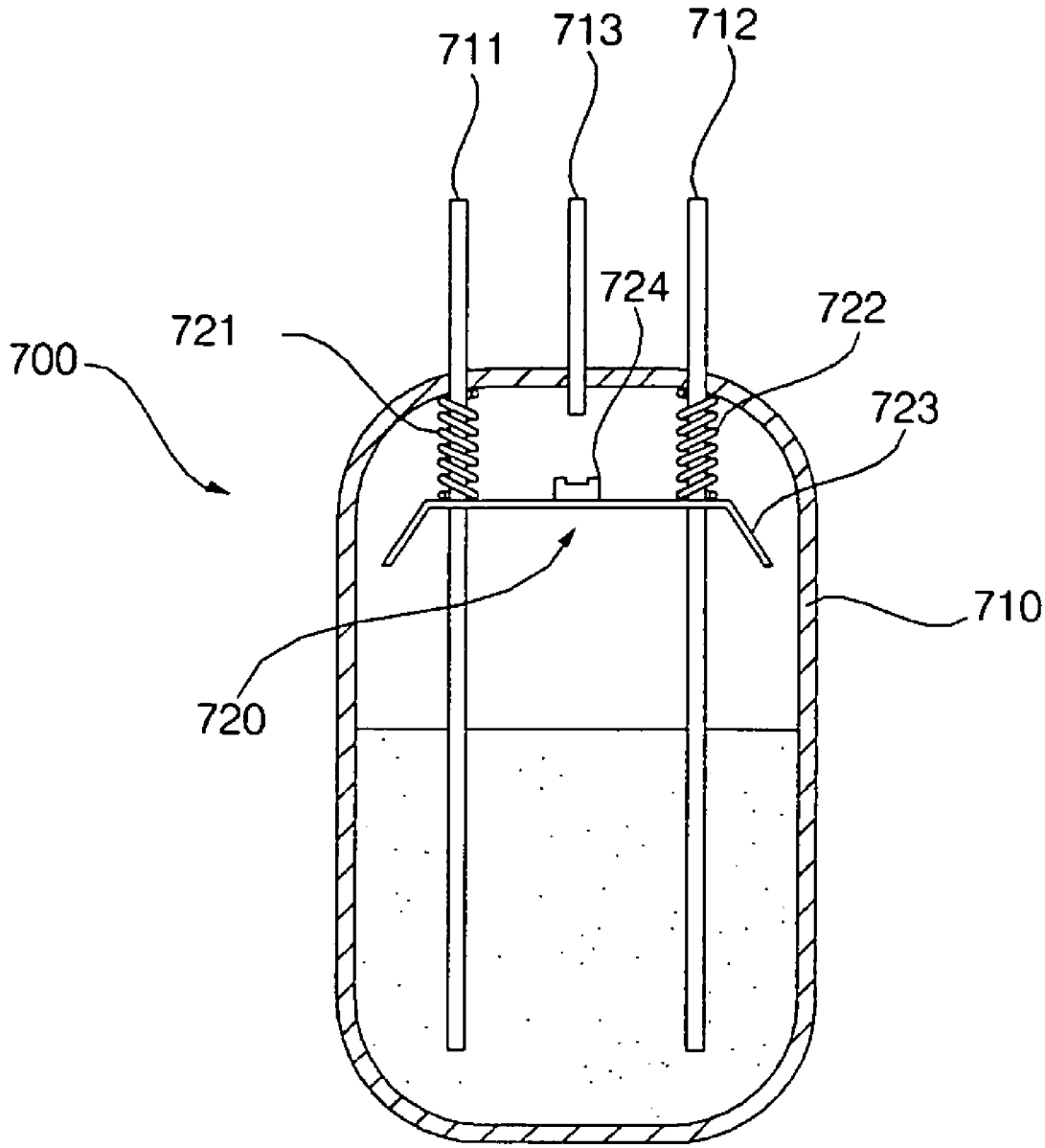
FIG. 14 is a configuration view of prevention means of an air conditioner in accordance with a seventh embodiment of the present invention.

FIG. 14 is a configuration view of prevention means of an air conditioner in accordance with a seventh embodiment of the present invention.

Referring to FIG. 14, prevention means includes a phase separator 700 disposed between a condenser (not shown) and an evaporator (not shown), and for introducing the refrigerant flown out from the condenser (not shown) after being throttled, and separating the phase of the introduced refrigerant. As described above, an outdoor heat exchanger (not shown) functions as a condenser in a cooling operation and functions as an evaporator in a heating operation. An indoor heat exchanger (not shown) functions as an evaporator in a cooling operation and functions as a condenser in a heating operation.

The phase separator 700 includes a body 710, a first connecting part 711, a second connecting part 712, a third connecting part 713, and a refrigerant pipe opening and closing part 720. The body 710 defines an internal space, and stores a gaseous refrigerant and a liquid refrigerant mixed therein. The first connecting part 711 is connected to a first expansion valve (not shown) and extends into the liquid refrigerant in the body 710, and the second connecting part 712 is connected to a second expansion valve (not shown) and extends into the liquid refrigerant in the body 710. Also, the third connecting part 713 is connected to an injection pipe (not shown), and inserted therein so as to be spaced apart from the stream surface of the liquid refrigerant. The first connecting part 711 is a refrigerant inlet pipe in a heating operation, and a liquid discharge pipe in a cooling operation. The second connecting part 712 is a liquid discharge pipe in a heating operation and a refrigerant inlet pipe in a cooling operation. The third connecting part 713 is a gaseous discharge pipe.

The refrigerant pipe opening and closing part 720 includes a horizontal member 723 disposed between the stream surface of a liquid refrigerant and the body 710 and first and second elastic members 721 and 722 disposed between the horizontal member 723 and the body 710. The first elastic member 721 is fitted to the first connecting part 711, with one end fixed to the inner surface of the body 710 and the other end fixed to the top surface of the horizontal member 723. The second elastic member 722 is fitted to the second connecting part 712, with one end fixed to the inner surface of the body 710 and the other end fixed to the top surface of the horizontal member 723. An enclosed part 724 is formed at the middle portion of the horizontal member 723.

Accordingly, if the stream surface of the liquid refrigerant is lower than a set evel, the first and second elastic members 721 and 722 elastically pushes the horizontal member 723 downward in order to keep the enclosed part 724 from closing the third connecting part 713. However, if the stream surface of the liquid refrigerant exceeds a set level, the stream surface of the liquid refrigerant pushes up the first and second elastic members 721 and 722 to make the enclosed part 724 close the third connecting part 713.

In a heating operation, a liquid refrigerant separated in the body 710 after the introduction of refrigerant into the first connecting part 711 is introduced into the outdoor heat exchanger (not shown) via the second expansion valve (not shown) through the second connecting part 712. A gaseous refrigerant is injected into a compressor (not shown) through the third connecting part 713.

In a cooling operation, a liquid refrigerant separated in the body 710 after the introduction of refrigerant into the second connecting part 712 is introduced into the indoor heat exchanger (not shown) via the first expansion valve (not shown) through the first connecting part 711.

In the phase separator 700, if the stream surface of the liquid refrigerant is higher than a set valve, the enclosed part 724 closes the third connecting part 713, thus avoiding the liquid refrigerant from being injected into the compressor (not shown) through the third connecting part 713. Subsequently, only a gaseous refrigerant is injected into the compressor through the third connecting part 713, thereby greatly reducing the possibility of liquid compression of the compressor (not shown).

In the foregoing embodiments, the air conditioners may include a plurality of prevention means. In this case, the introduction of a liquid refrigerant into the compressor is relatively further prevented, thereby greatly reducing the possibility of liquid compression of the compressor.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. An air conditioning system, comprising:

a condenser for condensing a refrigerant;

an evaporator for evaporating the refrigerant passed through the condenser;

a compressor for compressing the refrigerant passed through the evaporator and a refrigerant injected after being branched from the refrigerant flowing from the condenser to the evaporator; and a control unit for judging whether a liquid refrigerant is included in the injected refrigerant, wherein, if at least one of operating parameters is out of a preset normal operating range, the control unit judges that a liquid refrigerant is included in the injected refrigerant, and wherein the operating parameters include the discharge temperature and discharge pressure of the compressor, the inlet side temperature of the evaporator, the indoor temperature and outdoor temperature of the air conditioning system, and the current applied to the compressor.

2. The air conditioning system of claim 1, further comprising an injection pipe through which a refrigerant flows and an injection valve disposed on the injection pipe, and if it is judged that a liquid refrigerant is included in the injected refrigerant, the control unit controls the injection valve to be closed.

3. The air conditioning system of claim 1, further comprising an injection pipe through which the injected refrigerant flows and an insulating member disposed so as to cover at least part of the injection pipe.

4. The air conditioning system of claim 1, wherein the compressor is a capacity variable compressor, and if it is judged that a liquid refrigerant is included in the injected refrigerant, the control unit controls the frequency of the compressor to reduce the discharge flow rate of the compressor.

5. The air conditioning system of claim 1, further comprising:

a first expansion device for throttling the refrigerant introduced from the condenser;

a phase separator for separating the phase of the refrigerant introduced from the first expansion device; and a second expansion device for throttling the liquid refrigerant coming from the phase separator and supplying the same to the evaporator, and if it is judged that a liquid refrigerant is included in the injected refrigerant, the control unit decreases the opening degree of the first expansion device or increases the opening degree of the second expansion device.

6. The air conditioning system of claim 1, further comprising:

a first phase separator disposed between the condenser and the evaporator, and for introducing the refrigerant discharged from the condenser after being throttled, and separating the phase of the introduced refrigerant; and a second phase separator for separating the phase of the refrigerant introduced from the gaseous discharge pipe of the first phase separator.

7. The air conditioning system of claim 6, wherein the refrigerant pipe opening and closing part comprises:

a horizontal member disposed between the stream surface and the body; and an elastic member disposed between the horizontal member and the body, and if the stream surface is lower than a set level, elastically pushing the horizontal member downward in order to prevent the horizontal member from closing the gaseous discharge pipe and, if the stream surface exceeds a set level, closing the gaseous discharge pipe.

8. The air conditioning system of claim 1, further comprising a phase separator disposed between the condenser and the evaporator, and for introducing the refrigerant flown out from the condenser after being throttled, and separating the phase of the introduced refrigerant, the phase separator comprising: a body; an inlet pipe disposed at the body and for introducing the refrigerant passed through the condenser; a gaseous discharge pipe and a liquid discharge pipe which are inserted and disposed within the body, and for discharging the gaseous refrigerant and liquid refrigerant, respectively, separated from the refrigerant stored within the body; and a refrigerant pipe opening and closing part for opening and closing the gaseous discharge pipe with the rise and fall of the stream surface of the liquid refrigerant stored within the body.

9. The air conditioning system of claim 1, wherein, the compressor comprises a first compressing part for compressing the refrigerant passed through the evaporator and a second compressing part for compressing the refrigerant passed through the first compressing part and the injected refrigerant.

10. An air conditioning system, comprising:

a condenser for condensing a refrigerant;

an evaporator for evaporating the refrigerant passed through the condenser;

a compressor for compressing the refrigerant passed through the evaporator and a refrigerant injected after being branched from the refrigerant flowing from the condenser to the evaporator; and a control unit for judging whether a liquid refrigerant is included in the injected refrigerant, wherein, if at least one of operating parameters is out of a preset normal operating range, the control unit judges that a liquid refrigerant is included in the injected refrigerant, wherein the injected refrigerant flows through an injection pipe at which an injection valve is disposed, and if the operating parameter is out of the normal operating range, the injection valve is closed for a first set time, wherein, if the number of times of the operating parameter being out of the normal operation range exceeds a set number of times, the injection valve is closed for a second set time which is longer than the first set time.

11. The air conditioning system of claim 10, wherein, if the number of times of the operating parameter being out of the normal operation range exceeds a set number of times, a warning is indicated to the outside.

12. An air conditioning system, comprising: of claim 1, a condenser for condensing a refrigerant;

an evaporator for evaporating the refrigerant passed through the condenser;

a compressor for compressing the refrigerant passed through the evaporator and a refrigerant injected after being branched from the refrigerant flowing from the condenser to the evaporator; and a control unit for judging whether a liquid refrigerant is included in the injected refrigerant, wherein, if it is judged that a liquid refrigerant is included in the injected refrigerant, the control unit controls that the injected refrigerant is heated.

13. An air conditioning system, comprising:

a condenser for condensing a refrigerant;

an evaporator for evaporating the refrigerant passed through the condenser;

a compressor for compressing the refrigerant passed through the evaporator and a refrigerant injected after being branched from the refrigerant flowing from the condenser to the evaporator; and a control unit for judging whether a liquid refrigerant is included in the injected refrigerant, and further comprising an injection pipe through which the injected refrigerant flows, a bypass pipe for connecting the injection pipe and a discharge pipe of the compressor, and a bypass valve disposed on the bypass pipe, and if it is judged that a liquid refrigerant is included in the injected refrigerant, the control unit controls the bypass valve to be opened so that the refrigerant bypassed from the compressor heats the refrigerant injected into the compressor.

14. air conditioning system, comprising:

a condenser for condensing a refrigerant;

an evaporator for evaporating the refrigerant passed through the condenser;

a compressor for compressing the refrigerant passed through the evaporator and a refrigerant injected after being branched from the refrigerant flowing from the condenser to the evaporator; and a control unit for judging whether a liquid refrigerant is included in the injected refrigerant, and further comprising an injection pipe through which the injected refrigerant flows and a heater disposed on the injection pipe, and if it is judged that a liquid refrigerant is included in the injected refrigerant, the control unit operates the heater to heat the injected refrigerant.

15. An air conditioning system, comprising:

a condenser for condensing a refrigerant;

a first expansion device for throttling the refrigerant passed through the condenser;

a second expansion device for throttling the refrigerant passed through the first expansion device;

an evaporator for evaporating the refrigerant passed through the second expansion device;

a compressor having a first compressing part for compressing the refrigerant passed through the evaporator and a second compressing part for compressing both of the refrigerant passed through the first compressing part and a refrigerant injected after branched between the first expansion device and the second expansion device;

an injection valve for adjusting the amount of refrigerant injected into the second compressing part; and a control unit for, if it is judged that a liquid refrigerant is included in the injected refrigerant, controlling the injected refrigerant is to be heated.

* * * * *